US006374782B2

(12) United States Patent
Ishikawa et al.

(10) Patent No.: US 6,374,782 B2
(45) Date of Patent: Apr. 23, 2002

(54) AIR-FUEL MIXTURE GENERATING DEVICE

(75) Inventors: Takeshi Ishikawa, Tokyo; Yukio Sakaguchi; Yoshiaki Hironaka, both of Saitama; Kiyoshige Enomoto, Kanagawa, all of (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/759,047

(22) Filed: Jan. 12, 2001

(30) Foreign Application Priority Data

Jan. 12, 2000 (JP) ..... 2000-003663

(51) Int. Cl.[7] ..... F02M 71/00; F02M 51/00
(52) U.S. Cl. ..... 123/73 AF; 123/179.11
(58) Field of Search ..... 123/179.11, 179.12, 123/179.13, 179.14, 179.15, 179.16, 73 AD, 73 AF

(56) References Cited

U.S. PATENT DOCUMENTS 3,978,839 A * 9/1976 Dubois et al. ..... 123/179.11
4,375,206 A * 3/1983 Baltz et al. ..... 123/179.11
4,388,896 A * 6/1983 Sheridan et al. ..... 123/73 AD
4,480,602 A * 11/1984 Kobayashi et al. .... 123/73 AD
4,508,068 A * 4/1985 Tuggle et al. ..... 123/179.11
4,554,896 A * 11/1985 Sougawa ..... 123/179.11
4,660,516 A * 4/1987 Baltz et al. ..... 123/179.16
5,934,230 A 8/1999 Uytdewilligen et al.
6,000,369 A * 12/1999 Koizumi ..... 123/179.16

FOREIGN PATENT DOCUMENTS

JP 1018931 1/1998
JP 1162655 3/1999

* cited by examiner

*Primary Examiner*—Marguerite McMahon
(74) *Attorney, Agent, or Firm*—Baker Botts L.L.P.

(57) ABSTRACT

An air-fuel mixture generating device includes a main body equipped with a diaphragm-type fuel pump, a fuel injection valve attached to the main body, and a manual fuel pump attached to the main body for filling a fuel passageway with fuel when the diaphragm-type fuel pump is not operating. The manual fuel pump has an inlet port which communicates with the fuel passageway and a pressure-adjusting valve disposed at the inlet port of the manual fuel pump, thereby enabling it to act not only as an intake valve when the manual fuel pump is operated but also as a relief valve for allowing the fuel inside the fuel passageway to escape into a pump chamber of the manual fuel pump when the pressure of fuel inside the fuel passageway exceeds a predetermined pressure.

10 Claims, 2 Drawing Sheets

AIR-FUEL MIXTURE GENERATING DEVICE

FIELD OF THE INVENTION

The present invention relates to an air-fuel mixture generating device equipped with a diaphragm-type fuel pump, a fuel injection valve and a manual fuel pump, and in particular, to an air-fuel mixture generating device which is adapted to be employed, as an alternative to the conventional ordinary carburetor, for the intake system of an air-cooled two-stroke gasoline engine of the crankcase precompression type, which is particularly suitable for powering portable working machines and the like.

BACKGROUND OF THE INVENTION

For the intake system of a small air-cooled two-stroke gasoline engine of the crankcase precompression type (hereinafter referred to simply as an internal combustion engine), such as those used to power portable working machines such as chain saws or bush cutters, there is frequently employed, as an air-fuel mixture generating device, a floatless diaphragm-type carburetor equipped with a diaphragm-type fuel pump which is designed to induct fuel and to inject pressurized fuel in conformity with pressure changes (pulsating pressure) inside the crankcase of the internal combustion engine in order to ensure a stable supply of fuel to the engine irrespective of the posture of the engine.

However, it is difficult, with such a diaphragm-type carburetor, to precisely control the quantity of fuel in relation to the intake air (control of air/fuel ratio) and to achieve sufficient atomization of fuel and accurate response to the pulsating pressure, thereby making it difficult to effectively take measures for purifying the exhaust gas.

Under the circumstances, there has been recently proposed, as an alternative to the aforementioned carburetor, an air-fuel mixture generating device which is equipped with a fuel injection valve in addition to the aforementioned diaphragm-type fuel pump.

In an air-fuel mixture generating device of the aforementioned type, a diaphragm is disposed inside a main body that has a construction similar to that of a carburetor, a pulsating pressure chamber to which the pressure of the crankcase is transmitted is provided on one side of the diaphragm, and a pump chamber for inducting fuel and injecting it to a fuel passageway is provided on the other side of the diaphragm. The diaphragm is actuated (reciprocating movement) by taking advantage of the pressure changes (pulsating pressure) in the crankcase resulting from the movement of the piston of the internal combustion engine, i.e., the decrease in the pressure as the piston is moved upward and the increase in the pressure as the piston is moved downward, thereby enabling a pressurized fuel to be fed from the pump chamber to the fuel passageway and also enabling the fuel inside the fuel passageway to be pressurized. At the same time, the aforementioned fuel injection valve is allowed to open with a predetermined timing (for example, at the moment of the initiation of the suction stroke) for a predetermined period of time (for example, 1 to 3 milliseconds), depending on the operating condition of the internal combustion engine, to thereby enable the pressurized fuel in the fuel passageway to be injected into the intake system (for example, an intake passage portion located on the downstream side of the throttle valve) so as to be mixed into the inducted air, thereby producing an air-fuel mixture.

However, since the diaphragm-type fuel pump according to the aforementioned air-fuel mixture generating device is designed to be actuated by taking advantage of the pressure changes (pulsating pressure) inside the crankcase, the quantity of fuel to be injected by the diaphragm-type fuel pump is caused to greatly increase as the internal combustion engine is operated at a high speed (for example, 6000 rev/min or more), resulting in an excessive increase in pressure of the fuel disposed inside the fuel passageway (for example, the pressure will be increased up to nearly 0.1 MPa). As a result, the fuel is caused to be injected excessively from the fuel injection valve, thereby raising the problem that an excessively rich air-fuel mixture is fed to the combustion-actuating chamber of the internal combustion engine.

It may be considered, as one of the countermeasures for solving this problem, to incorporate a pressure-adjusting means such as a fuel pressure regulator, etc., into the pump chamber or the fuel passageway. However, the incorporation of the pressure-adjusting means such as the aforementioned regulator will make the resultant structure very complicated, thus increasing the manufacturing cost thereof.

SUMMARY OF THE INVENTION

The present invention has been made with a view to solving the aforementioned problems. It is, accordingly, an object of the present invention to provide an air-fuel mixture generating device which is equipped with a diaphragm-type fuel pump and a fuel injection valve, and is capable of preventing an excessive amount of fuel from being injected from the fuel injection valve, even if the internal combustion engine is operated at a high speed, without making the air-fuel mixture generating device complicated in construction and without greatly increasing the manufacturing cost thereof.

With a view to attaining the aforementioned objects, the present invention provides an air-fuel mixture generating device which essentially comprises:

a main body equipped with a diaphragm-type fuel pump which is designed to induct fuel and to inject the fuel into a fuel passageway in conformity with pressure changes inside the crankcase of the internal combustion engine;

a fuel injection valve attached to the main body for injecting the fuel of the fuel passageway into an intake system of the internal combustion engine with a predetermined timing;

a manual fuel pump attached to the main body for filling the fuel passageway with fuel on an occasion when the diaphragm-type fuel pump is not actuated, the manual fuel pump having an inlet port which is communicated with the fuel passageway; and a pressure-adjusting valve disposed at the inlet port of the manual fuel pump, thereby enabling it to act not only as an intake valve on an occasion when the manual fuel pump is actuated but also as a relief valve for allowing the fuel inside the fuel passageway to escape into a manual pump chamber of the manual fuel pump on an occasion when the pressure of fuel inside the fuel passageway exceeds a predetermined pressure.

In a preferred embodiment of the air-fuel mixture generating device according to the present invention, the diaphragm-type fuel pump is constituted by a diaphragm disposed inside the main body, a pulsating pressure chamber formed on one side of the diaphragm for receiving a pulsating pressure of the crankcase, and a pulsating pressure pumping chamber formed on the other side of the diaphragm for inducting fuel and injecting the fuel to the fuel passageway.

In another preferred embodiment of the air-fuel mixture generating device, it further comprises an intake valve which is formed at a portion of the diaphragm located between the pulsating pressure pump chamber and a fuel intake passageway portion, and an injection valve which is formed at a portion of the diaphragm located between the pulsating pressure pump chamber and the fuel passageway.

In another preferred embodiment of the air-fuel mixture generating device, an escape valve is disposed at an escape port of the manual fuel pump, the escape valve being designed to be closed when the pressure inside the manual pump chamber is less than a predetermined pressure, and also designed to be opened when the pressure inside the manual pump chamber is increased higher than said predetermined pressure.

The internal combustion engine to which the air-fuel mixture generating device of the present invention can be preferably applied is an air-cooled two-stroke gasoline engine of crankcase precompression type, wherein the injection port of the fuel injection valve is disposed on the downstream side of the throttle valve of the intake passageway.

With an air-fuel mixture generating device of the present invention constructed as described above, since fuel is required to be manually introduced into the fuel passageway at the time when the diaphragm-type fuel pump is not actuated, i.e., before the internal combustion engine is started, the air-fuel mixture generating device is equipped with the aforementioned manual fuel pump. When the manual fuel pump is actuated before starting the internal combustion engine, the fuel in a fuel tank is conducted, preferably, through the fuel intake passageway portion and the pulsating pressure pump chamber to the fuel passageway by the pumping action effected by the opening and closing movements, acting in opposite phase, of the pressure-adjusting valve disposed at the intake port of the manual fuel pump and of the escape valve disposed at the escape port of the manual fuel pump. When the internal combustion engine is started under this condition by means of a recoil starter, for example, the fuel injection port is caused to open with a predetermined timing (for example, at the moment of initiating the suction stroke), thereby enabling the fuel inside the fuel passageway to be sucked and fed to the intake system (for example, an intake passage portion located on the downstream side of the throttle valve) so as to be mixed into the inducted air at a proper ratio, the resultant air-fuel mixture being fed to the crankcase and combustion actuating chamber of the internal combustion engine so as to be ignited and explosively combusted by means of an ignition plug, thus realizing a self-sustaining normal rotational operation of the engine.

In the normal operation of the engine after the start-up, the pressure changes (pulsating pressure) inside the crankcase, i.e. a decrease in pressure in the ascending stroke of piston and an increase in pressure in descending stroke of piston, are transmitted to the pulsating pressure chamber of the diaphragm-type fuel pump, thereby driving the diaphragm (reciprocating movement). Due to the pumping action resulting from the vertical motion of the diaphragm, the fuel is sucked into the pumping chamber from the fuel tank, and then, fed from the pulsating pressure pump chamber to the fuel passageway so as to be compressed therein. During the normal operation of the engine, the fuel injection valve is caused to open with a predetermined timing (for example, at the moment of initiating the suction stroke) for a predetermined period of time (for example, 1 to 3 milliseconds), depending on the operation condition (such as the quantity of inducted air) of the internal combustion engine to thereby enable the pressurized fuel in the fuel passageway to be injected into the intake system (for example, an intake passage portion located on the downstream side of the throttle valve) so as to be mixed into the inducted air.

When the internal combustion engine operates at a high rotational speed, the pressure of fuel in the fuel passageway becomes higher due to the pumping action of the diaphragm. However, when the pressure of fuel in the fuel passageway becomes higher than a predetermined magnitude (for example, 0.05 MPa), the pressure-adjusting valve which is disposed at the intake port of the manual fuel pump is forced to open, thereby allowing the fuel inside the fuel passageway to escape into the manual pump chamber of the manual fuel pump. Subsequently, when the pressure inside the manual pump chamber becomes higher than a predetermined value, the escape valve which is disposed at the escape port of the manual fuel pump is forced to open, thereby allowing the fuel inside the manual pump chamber to return to an externally disposed fuel tank.

It is possible in this manner to inhibit the pressure (maximum pressure) of fuel inside the fuel passageway from exceeding the aforementioned predetermined value. As a result, it is possible to prevent injection of an excessive amount of fuel from the fuel injection valve and thereby the supply of an excessively rich air-fuel mixture to the combustion actuating chamber of the internal combustion engine.

According to the air-fuel mixture generating device of the present invention, a check valve which is indispensable for the manual fuel pump to be essentially employed in a case where the feeding of fuel is performed by making use of a diaphragm-type fuel pump together with a fuel injection valve is utilized in such a way that when the pressure of fuel inside the fuel passageway is less than a predetermined value, i.e., when the manual fuel pump is not operated or when the internal combustion engine is not in a state of high rotational speed, the check valve functions as a check valve as inherently intended, but when the pressure of fuel inside the fuel passageway exceeds the predetermined value, the check valve functions as a pressure-adjusting valve, i.e., a relief valve, for allowing the fuel inside the fuel passageway to escape into the manual pump chamber. Therefore, it is not necessary to integrate any additional fuel pressure regulator into the air-fuel mixture generating device. Thus, what is required in the device of the present invention is to suitably adjust the pressure of a spring, such as a coil spring employed in the check valve, thereby making it possible to prevent the device from becoming complicated in construction and to derive savings in the manufacturing costs thereof.

Additionally, with an air-fuel mixture generating device of the present invention, since the quantity of fuel can be controlled by means of the fuel injection valve, it is now possible to control the feeding quantity of fuel in relation to the quantity of inducted air (air/fuel ratio) with higher precision as compared with the conventional diaphragm-type carburetor, and to improve the atomization of fuel and the accurate response to the pulsating pressure, thereby making it possible to effectively purify the exhaust gas. Moreover, since the air-fuel mixture generating device of the present invention is constructed in almost the same manner as the conventional ordinary diaphragm-type carburetor except that the fuel feeding portion is modified with the fuel injection valve, the air-fuel mixture generating device of the present invention can be easily incorporated, in place of the conventional carburetor, into the conventional internal combustion engine.

DESCRIPTION OF THE EMBODIMENT

One embodiment of the air-fuel mixture generating device according to the present invention will be explained with reference to the drawings.

Figure 1:
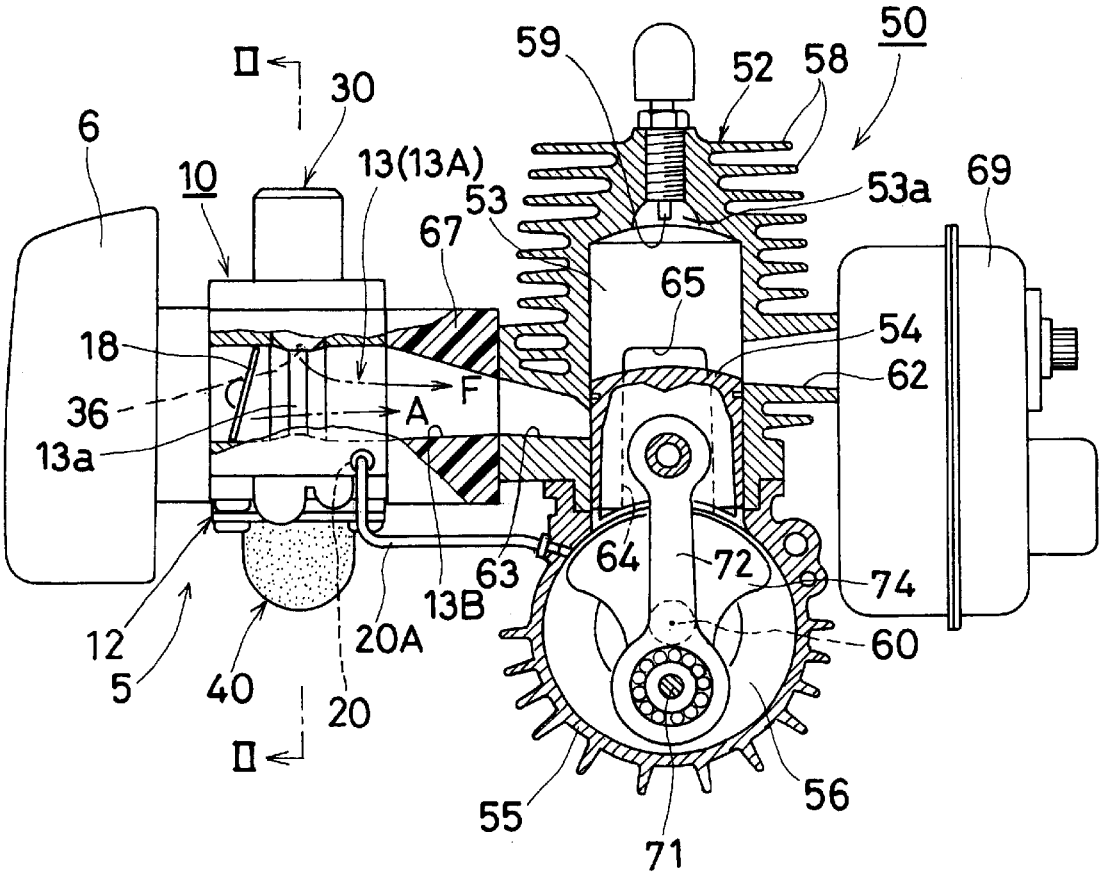
FIG. 1 is a longitudinal sectional view illustrating one embodiment of the air-fuel mixture generating device according to the present invention.
Figure 2:
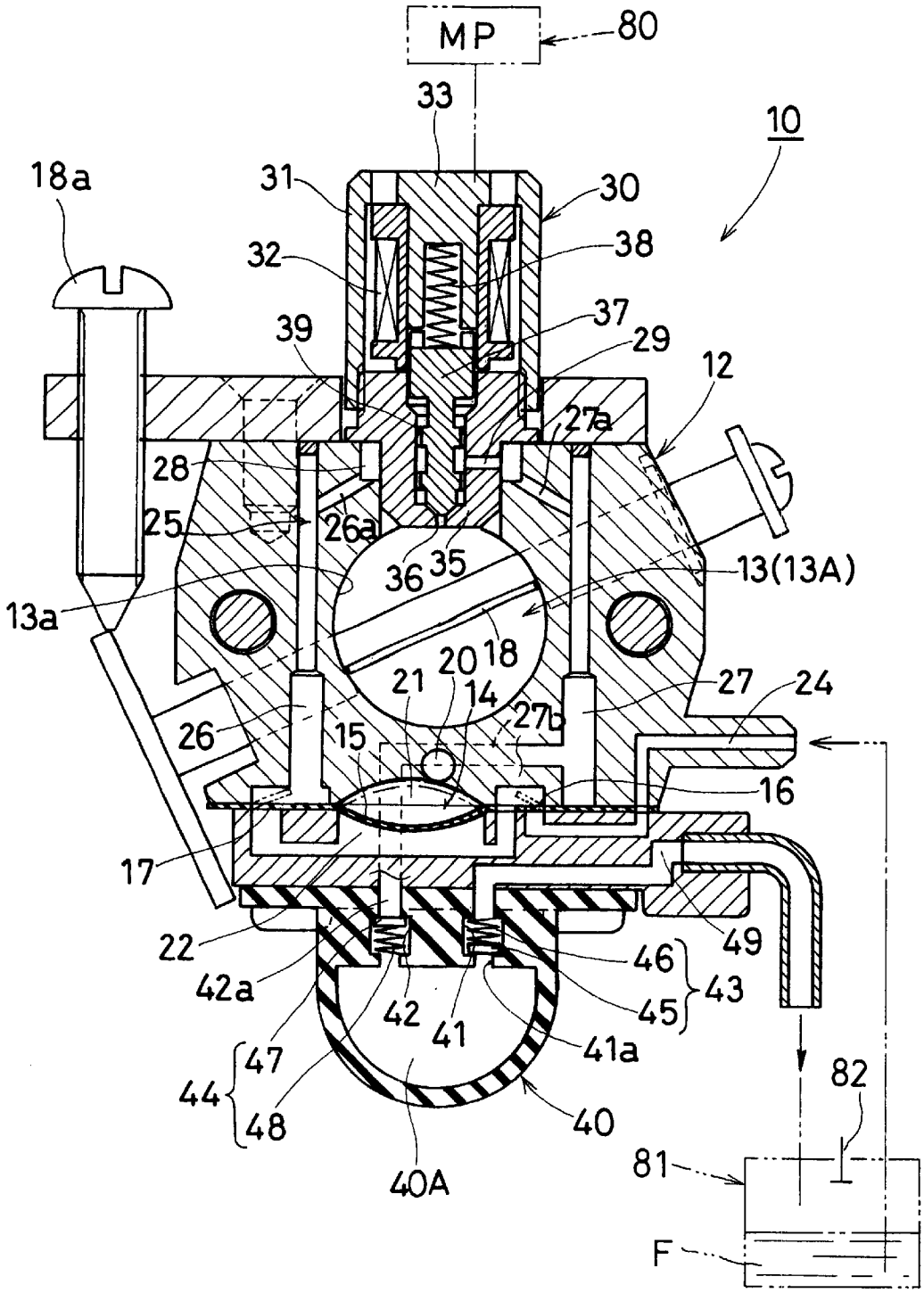
FIG. 2 is an enlarged cross-sectional view taken along the line II—II of FIG. 1.

FIG. 1 shows a longitudinal sectional view illustrating one embodiment of the air-fuel mixture generating device according to the present invention; and FIG. 2 shows an enlarged cross-sectional view taken along the line II—II of FIG. 1.

Referring to FIG. 1, the internal combustion engine 50 is formed of a small air-cooled two-stroke gasoline engine of crankcase precompression type which is adapted to be mounted on a portable working machine, such as a bush cutter, etc. The internal combustion engine 50 comprises a cylinder 52 in which a piston 54 is slidably fitted enabling the piston 54 to be moved in the axial direction, and a crankcase 55 connected with the lower end of the cylinder 52 and having a crankcase chamber 56 therein. The cylinder 52 is provided with a large number of cooling fins 58 on the outer circumferential wall thereof, and also with an ignition plug 59 which is positioned at the top portion (combustion chamber 53*a*) of the combustion actuating chamber 53 located over the piston 54.

The crankcase 55 is formed of a short cylindrical shape and hermetically closed. A crank shaft 60 is axially supported by the central portions of the right and left sidewalls of the crankcase 55. The piston 54 is connected via a connecting rod 72 with a crank pin 71 of the crank shaft 60. A pair of crank webs 74 are fixed at the right and left ends of the crank pin 71 in such a manner that the connecting rod 72 is interposed between the pair of crank webs 74.

The cylinder 52 is provided, at an inner wall portion thereof, with an exhaust gas port 62 which is directed orthogonally to the longitudinal direction of the crank shaft 60, and at another inner wall portion thereof, with a suction port 63 which is located lower than and facing the exhaust gas port 62 (i.e., displaced by an angle of 180 degrees). Furthermore, a pair of scavenging ports 65 forming a so-called Schnurle scavenging system are formed at inner wall portions of the cylinder 52, which are located respectively at an intermediate portion between the exhaust gas port 62 and the suction port 63, i.e. both scavenging ports 65 facing each other and being spaced apart by an angle of 90 degrees from the exhaust gas port 62 as well as from the suction port 63. These scavenging ports 65 are respectively extended down to the lower portion of the cylinder 52 so as to be communicated with the top end of the scavenging passageway 64 communicated with the crankcase chamber 56.

To one side of the cylinder 52 where the suction port 63 is located, there is attached, via a heat insulator 67, an intake system 5 forming an intake passageway 13, which is incorporated with the air-fuel mixture generating device 10 according to one embodiment of the present invention and also with an air cleaner 6. To the other side of the cylinder 52 where the exhaust port 62 is located, there is attached a muffler 69 equipped with an exhaust gas purifying mechanism. The intake passageway 13 is constituted by a choking passageway 13A passing through a portion of the air-fuel mixture generating device 10 and by a passageway 13B passing through a portion of the heat insulator 67. An idle automatic reset type throttle valve 18 is disposed on the upstream side of the choking passageway 13A formed in the air-fuel mixture generating device 10.

The reference number 18*a* in FIG. 2 denotes an adjustor screw for regulating the minimum opening degree of the throttle valve 18 so at to adjust the idling revolving speed of the internal combustion engine 50.

The air-fuel mixture generating device 10 comprises a main body 12 which is similar in appearance to the conventional diaphragm-type carburetor and is equipped with a diaphragm-type fuel pump 14 which is designed to induct fuel F from a fuel tank 81 furnished with a breather 82 and to inject the fuel F into a fuel passageway 25 (26–29) in conformity with pressure changes (pulsating pressure) inside the crankcase chamber 56 of the internal combustion engine 50.

A fuel injection valve 30 for injecting, with a predetermined timing, the fuel F that has been introduced into the fuel passageway 25 and compressed to a predetermined magnitude into the intake passageway 13 (the choking passageway 13A) located on the downstream side of the throttle valve 18 is disposed just over the choking portion (throat portion) 13*a* of the choking passageway 13A of the main body 12.

A manual fuel pump 40 for filling the fuel passageway 25 with the fuel F at the time when the diaphragm-type fuel pump 14 is not actuated is disposed at a lower portion of the main body 12.

The diaphragm-type fuel pump 14 is constituted by a diaphragm 15 disposed inside the main body 12 and made of nylon or Teflon® sheet laminated with a rubber layer, a pulsating pressure chamber 21 which is formed over the top surface of the diaphragm 15 and to which the pulsating pressure of the crankcase chamber 56 is designed to be transmitted via a pulsating pressure passageway 20 (including a pipe 20A shown in FIG. 1) placed horizontally inside the main body 12, and a pulsating pressure pump chamber 22 which is formed below the rear surface of the diaphragm 15 and designed to induct fuel F from the fuel tank 81 through a fuel intake passageway 24 and to inject the fuel F into the fuel passageway 25.

The air-fuel mixture generating device 10 further comprises a flap valve 16 as an intake valve which is formed at a portion of the diaphragm 15 located between the pulsating pressure pump chamber 22 and the fuel intake passageway portion 24, and a flap valve 17 as an injection valve which is formed at a portion of the diaphragm 15 located between the pulsating pressure pump chamber 22 and the fuel passageway 25, both flap valves 16 and 17 being formed by respectively cutting a portion of the diaphragm 15 into a U-shape.

The fuel injection valve 30 is of an electromagnetic-driven type and is constituted by a cylindrical housing 31, a field coil 32, a stator (magnetic attraction element) 33, a plunger (valve body) 37 having a conically stepped distal end (a lower end portion), a valve seat 35 having an injection port 36 arranged to be opened and closed by means of the plunger 37, and a compression coil spring 38 interposed between the stator 33 and the plunger 37. The injection port 36 is opened to the choking portion 13*a* of the choking passageway 13A of the intake passageway 13, which is located on the downstream side of the throttle valve 18.

According to the fuel injection valve 30, a pulse signal having a specific pulse width (duty ratio) corresponding to the operating conditions of the internal combustion engine 50 such as rotational speed, load, vibration, temperature, etc. is transmitted, with a predetermined timing (for example, at the moment of the initiation of the suction stroke), to the field coil 32 through an automatic controlling device 80, which may be based on various kinds of sensors, microprocessors, etc. As a result, the field coil 32 is electrically magnetized to thereby pull up the plunger 37 against the urging force of the coil spring 38 for a period of time corresponding to the width of pulse (a time period of the electrical magnetization), thereby allowing the injection port 36 to open so as to adjust the quantity of fuel injection. It is also possible to adjust the quantity of fuel injection by feeding a predetermined number of pulses of constant breadth and at predetermined intervals during the suction stroke in conformity with the operating state of the internal combustion engine 50.

The fuel passageway 25 is mainly constituted by a first passageway 26 communicated via the flap valve 17 on the injection side with the pulsating pressure pump chamber 22, an annular reserve chamber 28 formed around the valve seat 35 of the fuel injection valve 30 and communicated via a first communicating passage 26*a* with the first passageway 26 and via an injection valve side passage 29 and the plunger 37 with the injection port 36, a second passageway 27 communicated via a second communicating passage 27*a* with the reserve chamber 28, and a pump side passage 27*b* enabling the second passageway 27 to communicate via a pressure-adjusting valve (suction valve) 44 (to be explained hereinafter) with a manual pump chamber 40A of the manual fuel pump 40.

The manual fuel pump 40 is provided because fuel is required to be manually introduced into the fuel passageway 25 at the time when the diaphragm-type fuel pump 14 is not actuated, i.e., before the internal combustion engine 50 is started. The manual fuel pump 40 is formed of an elastic material such as rubber and has a manual pump chamber 40A of semi-spherical configuration, a suction port 42 equipped with the above-mentioned pressure-adjusting valve 44, and an escape port 41 equipped with a release (escape) valve 43. The manual pump chamber 40A can be easily depressed with one's fingers and then is restored by its own elastic force to the original semi-spherical configuration when it is released from the pressing force.

The pressure-adjusting valve 44 disposed at the suction port 42 includes a disk-like valve body 47 for closing or opening the upper opening 42*a* of the suction port 42 and a compression coil spring 48 for urging the valve body 47 to close the upper opening 42*a* (upward direction). The pressure-adjusting valve 44 is designed such that it is capable of acting not only as a check valve (an intake valve) on the occasion when the manual fuel pump 40 is actuated but also as a relief valve for allowing the fuel F inside the fuel passageway 25 to escape into the manual pump chamber 40A on the occasion when the pressure of fuel inside the fuel passageway 25 exceeds a predetermined magnitude.

The escape valve 43 disposed at the escape port 41 includes a disk-like valve body 45 for closing or opening the lower opening 41*a* of the escape port 41 and a compression coil spring 46 for urging the valve body 45 to close the lower opening 41*a* (downward direction). The escape valve 43 is designed such that it closes the lower opening 41*a* when the pressure inside the manual pump chamber 40A is less than a predetermined magnitude, and opens the lower opening 41*a* when the pressure inside the manual pump chamber 40A becomes higher than the predetermined magnitude to thereby allow the air and fuel F present in the manual pump chamber 40A to escape via an escape passage 49 into the fuel tank 81.

The air-fuel mixture generating device 10 constructed in the manner according to the embodiment can be operated as follows. When the diaphragm-type fuel pump 14 is not yet actuated (i.e., before the internal combustion engine 50 is started), a pumping operation of the device 10—i.e., an operation wherein the manual pump chamber 40A of the manual fuel pump 40 is depressed by applying the pressure of one's fingers to it and then is allowed to restore the original configuration thereof by releasing the pressing force—is repeated several times. By the pumping operation of the device 10, the pressure-adjusting valve 44 disposed at the suction port 42 as well as the escape valve 43 disposed at the escape port 41 are enabled to function as a suction valve and an injection valve, respectively, thus achieving the pumping function of the device 10.

More specifically, when the manual pump chamber 40A is collapsed, the inner volume of the manual pump chamber 40A is compressed, thereby enabling the pressure-adjusting valve 44 to close the suction port 42 (the upper opening 42*a*) and at the same time, enabling the escape valve 43 to open the escape port 41 (the lower opening 41*a*). As a result, the air A and fuel F existing in the manual pump chamber 40A are enabled to return through the escape port 41 and the escape passage 49 to the fuel tank 81. On the other hand, when the pressing force is released, the manual pump chamber 40A is allowed to restore, by its own elastic force, to its original semi-spherical configuration, and at the same time, the escape valve 43 is actuated to close the escape port 41 (the lower opening 41*a*) and the pressure-adjusting valve 44 is actuated to open the suction port 42 (the upper opening 42*a*).

In this manner, due to the suction force (negative pressure) that has been generated at the moment of the restoration of the manual pump chamber 40A, the fuel F in the fuel tank 81 is introduced, via the fuel intake passageway 24, the pulsating pressure pump chamber 22 and the flap valve 17 on the injection side into the fuel passageway 25 (26–29), thereby filling the fuel passageway 25 (26–29) as well as the region around the plunger 37 of the fuel injection valve 30 with the fuel F.

When the internal combustion engine 50 is started by the manipulation of the recoil starter, etc., the fuel injection valve 30 is permitted to open with a predetermined timing (for example, at the moment of the initiation of the suction stroke) to thereby allow the fuel present in the fuel passageway 25 to be drawn out from the injection port 36 provided at the choking portion 13*a* which is located on the downstream side of the throttle valve 18 so as to be mixed into the inducted air A. The resultant air-fuel mixture is then fed to the crankcase chamber 56 and to the combustion chamber 53 of the internal combustion engine 50, thus allowing the air-fuel mixture to be ignited and explosively burned by means of the ignition plug 59 and achieving a self-sustaining normal rotational operation of the internal combustion engine 50.

In the normal operation of the internal combustion engine 50 after the start-up, the pressure changes (pulsating pressure) inside the crankcase chamber 56, i.e., a decrease in pressure in the ascending stroke of the piston 54 and an increase in pressure in descending stroke of the piston 54, are transmitted to the pulsating pressure chamber 21 of the diaphragm-type fuel pump 14, thereby reciprocatively driving the diaphragm 15 (reciprocating movement). Due to the pumping action resulting from the vertical motion of the diaphragm 15, the fuel F is sucked into the pumping chamber 22 from the fuel tank 81 and then fed from the pulsating pressure pump chamber 22 to the fuel passageway 25 (26–29) so as to be compressed therein during the period of time when the injection port 36 is closed. During the normal operation of the internal combustion engine 50, the fuel injection valve 30 is allowed to open with a predetermined timing (for example, at the moment of the initiation of the suction stroke) for a predetermined period of time (for example, 1 to 3 milliseconds), depending on the operation condition (such as the quantity of inducted air) of the internal combustion engine 50 to thereby enable the pressurized fuel F in the fuel passageway 25 to be injected into the intake passage 13 portion which is located on the downstream side of the throttle valve 18 so as to enable the fuel F to be mixed into the inducted air A.

When the internal combustion engine 50 operates at a high rotational speed, the quantity of fuel injected from the diaphragm-type fuel pump 14 is increased and hence the pressure of fuel F existing inside the fuel passageway 25 becomes higher. However, when the pressure of fuel F present inside the fuel passageway 25 becomes higher than a predetermined magnitude (for example, 0.05 MPa), the upper opening 42*a* is allowed to open by the pressure-adjusting valve 44 which is disposed at the intake port 42 of the manual fuel pump 40, thereby allowing the fuel F present inside the fuel passageway 25 to escape into the manual pump chamber 40A of the manual fuel pump 40. Subsequently, when the pressure inside the manual pump chamber 40A becomes higher than a predetermined value, the lower opening 41*a* is allowed to open by the escape valve 43 which is disposed at the escape port 41 of the manual fuel pump 40, thereby allowing the fuel F present inside the manual pump chamber 40A to return to the fuel tank 81.

It is possible in this manner to inhibit the pressure (maximum pressure) of fuel F existing inside the fuel passageway 25 from exceeding the aforementioned predetermined value. As a result, it is possible to prevent the occurrence of such a situation that the fuel F is excessively injected from the fuel injection valve 30 to thereby feed an excessively concentrated air-fuel mixture to the combustion chamber 53 of the internal combustion engine 50.

According to the air-fuel mixture generating device 10 of the embodiment, a check valve, which is indispensable for the manual fuel pump employed in a case where the fuel is fed by a diaphragm-type fuel pump together with a fuel injection valve, is utilized in such a way that when the pressure of fuel F existing inside the fuel passageway 25 is less than a predetermined value, i.e., when the manual fuel pump 40 is not operated or when the internal combustion engine 50 is not in a state of high rotational speed, the check valve functions as a check valve as inherently intended, but when the pressure of fuel F existing inside the fuel passageway 25 exceeds the predetermined value, the check valve functions as a pressure-adjusting valve, i.e., a relief valve, for allowing the fuel F present inside the fuel passageway 25 to escape into the manual pump chamber 40A. Therefore, it is not necessary to integrate any additional fuel pressure regulator into the air-fuel mixture generating device. Thus, what is required in the device of the embodiment is to suitably adjust the pressure of a spring, such as a coil spring employed in the check valve, thereby making it possible to simplify the construction of the device and to save on the manufacturing cost thereof.

Additionally, according to the air-fuel mixture generating device 10 of the embodiment, since the quantity of fuel can be controlled by means of the fuel injection valve, it is now possible to control the feeding quantity of fuel in relation to the quantity of inducted air (air/fuel ratio) with higher precision, as compared with the conventional diaphragm-type carburetor, and to improve the atomization of fuel and the accurate response to the pulsating pressure, thereby making it possible to effectively purify the exhaust gas. Moreover, since the air-fuel mixture generating device of the embodiment is constructed in almost the same manner as the conventional ordinary diaphragm-type carburetor except that the fuel feeding portion is modified with the fuel injection valve, the air-fuel mixture generating device of the embodiment can be easily incorporated into the conventional internal combustion engine.

Although one embodiment of the present invention has been explained in the foregoing description, it should be understood that the present invention is not limited to these embodiments, but can be varied without departing from the spirit and scope of the invention set forth in the accompanying claims.

For example, although the air-fuel mixture generating device 10 according to the aforementioned embodiment is placed at the intake passageway 13 of the internal combustion engine 50, the air-fuel mixture generating device 10 of the present invention may be attached to an intake system other than the aforementioned intake passageway. For example, the air-fuel mixture generating device 10 may be directly coupled via a reed valve to the crankcase of the internal combustion engine.

As seen from the above explanation, it is possible, according to the present invention, to provide an air-fuel mixture generating device, which is capable of preventing fuel from being excessively injected from the fuel injection valve even if the internal combustion engine is operated at a high speed.

Additionally, it is not required to integrate any additional fuel pressure regulator into the air-fuel mixture generating device, thereby making it possible to prevent the device from becoming complicated in structure and to avoid increases in the manufacturing costs thereof.

Furthermore, since the quantity of fuel can be controlled by means of the fuel injection valve, it is now possible to control the feeding quantity of fuel in relation to the quantity of inducted air (air/fuel ratio) with higher precision as compared with the conventional diaphragm-type carburetor, and to improve the atomization of fuel and the accurate response to the pulsating pressure, thereby making it possible to effectively purify the exhaust gas. Moreover, since the air-fuel mixture generating device of the present invention can be constructed in almost the same manner as the conventional ordinary diaphragm-type carburetor except that the fuel feeding portion is modified with the fuel injection valve, the air-fuel mixture generating device of the present invention can be easily incorporated, in place of the conventional carburetor, into the conventional internal combustion engine.

What is claimed is:

1. An air-fuel mixture generating device comprising a main body equipped with a diaphragm-type fuel pump to supply fuel to a fuel passageway in accordance with pressure changes in the crankcase chamber of an internal combustion engine;

a fuel injection valve attached to the main body for injecting fuel present in the fuel passageway into an intake system of the internal combustion engine with a predetermined timing;

a manual fuel pump attached to the main body for filling the fuel passageway with fuel on an occasion when the diaphragm-type fuel pump is not operating, said manual fuel pump having an inlet port which is communicated with the fuel passageway; and a pressure-adjusting valve disposed at the inlet port of the manual fuel pump, thereby enabling it to act not only as an intake valve on an occasion when the manual fuel pump is actuated but also as a relief valve for allowing the fuel inside the fuel passageway to escape into a manual pump chamber of the manual fuel pump on an occasion when the pressure of fuel inside the fuel passageway exceeds a predetermined pressure.

2. The air-fuel mixture generating device according to claim 1, wherein the diaphragm-type fuel pump includes a diaphragm disposed inside the main body, a pulsating pressure chamber formed on one side of the diaphragm for receiving a pulsating pressure of the crankcase, and a pulsating pressure pumping chamber formed on the other side of the diaphragm for inducting fuel and injecting the fuel to the fuel passageway.

3. The air-fuel mixture generating device according to claim 2, which further comprises an intake valve which is formed at a portion of the diaphragm located between the pulsating pressure pump chamber and a fuel intake passageway portion, and an injection valve which is formed at a portion of the diaphragm located between the pulsating pressure pump chamber and the fuel passageway.

4. The air-fuel mixture generating device according to claim 1, which further comprises an escape valve which is disposed at an escape port of the manual fuel pump, the escape valve being arranged to be closed when the pressure inside the manual pump chamber is less than a predetermined pressure and to be opened when the pressure inside the manual pump chamber exceeds said predetermined pressure.

5. The air-fuel mixture generating device according to claim 2, which further comprises an escape valve which is disposed at an escape port of the manual fuel pump, the escape valve being arranged to be closed when the pressure inside the manual pump chamber is less than a predetermined pressure and to be opened when the pressure inside the manual pump chamber exceeds said predetermined pressure.

6. The air-fuel mixture generating device according to claim 3, which further comprises an escape valve which is disposed at an escape port of the manual fuel pump, the escape valve being arranged to be closed when the pressure inside the manual pump chamber is less than a predetermined pressure and to be opened when the pressure inside the manual pump chamber exceeds said predetermined pressure.

7. The air-fuel mixture generating device according to claim 1, wherein the internal combustion engine is an air cooled two-stroke gasoline engine of the crankcase precompression type, the intake passage includes a throttle valve, and fuel is supplied to the intake passageway by a fuel injection valve having an injection port disposed downstream from the throttle valve.

8. The air-fuel mixture generating device according to claim 2, wherein the internal combustion engine is an air cooled two-stroke gasoline engine of the crankcase precompression type, the intake passage includes a throttle valve, and fuel is supplied to the intake passageway by a fuel injection valve having an injection port disposed downstream from the throttle valve.

9. The air-fuel mixture generating device according to claim 3, wherein the internal combustion engine is an air cooled two-stroke gasoline engine of the crankcase precompression type, the intake passage includes a throttle valve, and fuel is supplied to the intake passageway by a fuel injection valve having an injection port disposed downstream from the throttle valve.

10. The air-fuel mixture generating device according to claim 4, wherein the internal combustion engine is an air cooled two-stroke gasoline engine of the crankcase precompression type, the intake passage includes a throttle valve, and fuel is supplied to the intake passageway by a fuel injection valve having an injection port disposed downstream from the throttle valve.

* * * * *